United States Patent [19]

Shilcock

[11] Patent Number: 4,564,106

[45] Date of Patent: Jan. 14, 1986

[54] LIFTING DEVICE WITH TONGUE FLAPS

[75] Inventor: John Shilcock, Liversedge, England

[73] Assignee: Waddingtons Limited, Leeds, England

[21] Appl. No.: 557,815

[22] Filed: Dec. 5, 1983

Related U.S. Application Data

[63] Continuation-in-part of Ser. No. 492,301, May 6, 1983, abandoned.

[51] Int. Cl.[4] ..... B65D 5/46

[52] U.S. Cl. ..... 206/165; 206/162; 229/52 A; 294/87.2

[58] Field of Search ..... 206/162, 164, 165, 427, 206/142, 143; 229/52 A, 52 BC; 294/87.2

[56] References Cited

U.S. PATENT DOCUMENTS

| | | | |
|---|---|---|---|
| 1,492,100 | 4/1924 | Krueger . | |
| 1,965,503 | 7/1934 | Lowman | 229/52 |
| 2,405,914 | 8/1946 | Van Rosen | 229/52 A |
| 2,434,630 | 1/1948 | Van Rosen | 229/52 A |
| 2,457,308 | 12/1948 | Hall et al. | 224/45 |
| 2,475,014 | 7/1949 | Crary et al. | 229/52 |
| 2,677,460 | 5/1954 | Johnson et al. . | |
| 2,853,224 | 9/1958 | Slater et al. | 229/52 A |
| 2,874,835 | 2/1959 | Poupitch . | |
| 2,997,169 | 8/1961 | Poupitch . | |
| 3,305,085 | 2/1967 | Rossi . | |
| 3,695,418 | 10/1972 | Gwozdz | 206/45.33 |
| 3,700,276 | 10/1972 | Klygis | 294/87.2 |
| 3,707,806 | 2/1973 | Toews et al. | 47/34.13 |
| 3,726,558 | 4/1973 | Klygis | 294/87.2 |
| 3,822,012 | 7/1974 | Weaver | 206/87.2 |
| 4,030,661 | 6/1977 | Farquhar | 229/52 |
| 4,318,476 | 3/1982 | Wood et al. | 206/459 |
| 4,339,032 | 7/1982 | Wood | 206/158 |
| 4,372,600 | 2/1983 | Leib, Jr. | 294/87.2 |
| 4,403,689 | 9/1983 | Wood | 206/158 |

FOREIGN PATENT DOCUMENTS

| | | | |
|---|---|---|---|
| 0543962 | 7/1957 | Canada | 229/52 A |
| 0823271 | 11/1959 | United Kingdom | 229/52 A |
| 0879180 | 10/1961 | United Kingdom | 229/52 A |
| 914202 | 12/1962 | United Kingdom . | |
| 960218 | 6/1964 | United Kingdom . | |
| 1017984 | 1/1966 | United Kingdom . | |
| 1029680 | 5/1966 | United Kingdom . | |
| 1137126 | 12/1968 | United Kingdom . | |
| 1338871 | 11/1973 | United Kingdom . | |
| 1372683 | 11/1974 | United Kingdom . | |
| 1388305 | 3/1975 | United Kingdom . | |
| 1398442 | 6/1975 | United Kingdom . | |

*Primary Examiner*—George E. Lowrance
*Assistant Examiner*—Jimmy G. Foster
*Attorney, Agent, or Firm*—David A. Jackson; Daniel H. Bobis

[57] ABSTRACT

The invention provides a lifting device for lifting a group of containers held together by a holding device. The lifting device is of cut and creased sheet material and has a tongue which is passed through an aperture or each of or several apertures in the holding device, and flaps of the tongues folded back onto the tongues spring out to rest against the containers and engage under the holding device so that lifting of the lifting device effects lifting of the containers by the flaps engaging under the holding device.

12 Claims, 16 Drawing Figures

LIFTING DEVICE WITH TONGUE FLAPS

CROSS-REFERENCE TO RELATED APPLICATION

The present application is a continuation-in-part of copending application Ser. No. 492,301, filed May 6, 1983, by the Inventor herein, now abandoned.

This invention relates to devices for use in connection with the lifting of groups of containers which are held together by means of holding devices. A particular holding device is in fact a web of plastics material provided with apertures, and in which apertures the containers are frictionally and resiliently held.

Such particular holding device has been almost universally adopted for holding together cans for beverages such as beer, which are generally cylindrical, and are closed by means of a ring pull closure lid. The described holding device is known by the name "HICONE" (registered trade mark).

The HICONE holding device is essentially a sheet of plastics material which is provided with the apertures, and which is forced over the can ends to hold the containers frictionally and resiliently. The sheet material is subsequently cut so as to provide individual holding devices which retain cans in groups such as four arranged in a square array, or in sixes, eights or twelves, in two rows or three rows of four in the case of a twelve pack, the cans being held together so that the wall regions of adjacent cans are close together.

The holding device for holding cans as described is provided with an aperture which is located centrally in each groups of four containers in a square array in the pack, and which is somewhat diamond shaped, this being provided to save plastics material and also to provide an insertion hole for a finger or thumb to enable the pack of containers to be lifted and transported.

More recently, there has been introduced a holding device which competes with the HICONE device, such competing device comprising a plastic clip of cross shape of which the arms clip the lips of adjacent containers holding them together, so that such clip holds four containers in a square array. The clip has a central aperture the function of which is the same as the aperture at the centre of each four containers in a HICONE device.

The present invention is useable with the clip type of holding device and indeed is useable with any holding device which holds a group of containers together and has an aperture around which the tops of the containers are arranged. When reference is made herein therefore to holding devices, what is meant is a holding device holding the containers in a group with the tops of the containers around an aperture in the holding device.

A group of cans held together by a holding device can be lifted by inserting the fingers in the aperture or apertures in the holding device, or by lifting one can of the group, so that all are lifted.

Occasionally, there are so-called special offers regarding cans of beer whereby the purchaser is offered a pack of cans for the price of one less, and there has arisen a need therefore to provide a means which will enable the offer to be displayed, without of necessity altering the printing on the cans themselves.

The present invention aims at providing such a means, but it also provides additional functions, which are that of enabling the group of containers to be lifted, of providing a display illustrating the products, and generally enhancing the display of the products.

In accordance with the invention, there is provided a lifting device which is manufactured from cut and creased sheet material, such device being adapted to fit into an aperture or several apertures of a holding device holding a group of containers held together, the said lifting device providing on the one hand a handle and also a display area whereby printing maybe carried thereby for the purposes, for example, of indicating a special offer, the device including for the or each aperture at least one tongue having at least one catching flap hinged thereto for folding back by substantially 180° towards the tongue whilst the tongue is inserted through an aperture in the holding device, until the flap springs back to engage under the holding device to provide a means for lifting the group of containers, the said flap being of such size in relation to the aperture and containers that the flap cannot spring back by more than 90° before coming to rest.

There may be two of said flaps on the said at least one tongue and there may be two tongues each with one or more flaps for insertion in the same holding device apertures.

Specifically, the device comprises a blank of cut and creased material which is folded in two so that tongue portions of the blank come together to define a tongue pair each of which has a hingeable flap and the flaps are folded onto the outsides of the tongues, and the tongues and folded flaps are inserted in at least one aperture and released so that the flaps spring outwards in opposite directions and catch under the holding device whereby the group of containers can be lifted by lifting the lifting device.

Release of the holding flaps enables them to spring outwards to a position whereby they will catch the underside of the holding device enabling the lifting device according to the invention to provide a means enabling the group of containers to be lifted, through the intermediary of the holding device.

Embodiments of the present invention will now be described, by way of example, with reference to the accompanying drawings, wherein.

Figure 1:
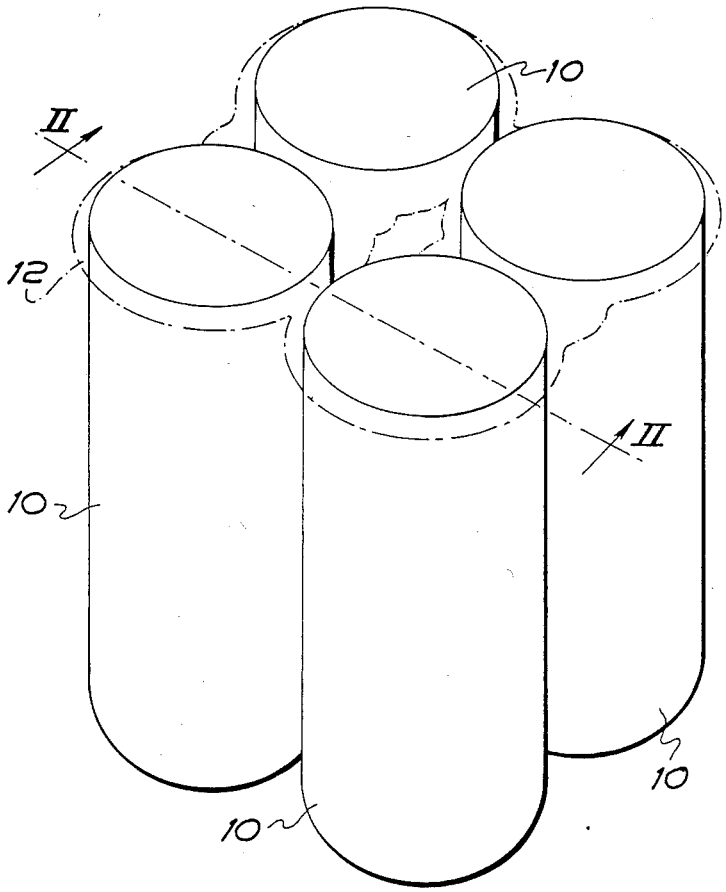
FIG. 1 is a perspective view showing a group of containers held together by a holding device of the type HICONE.
Figure 2:
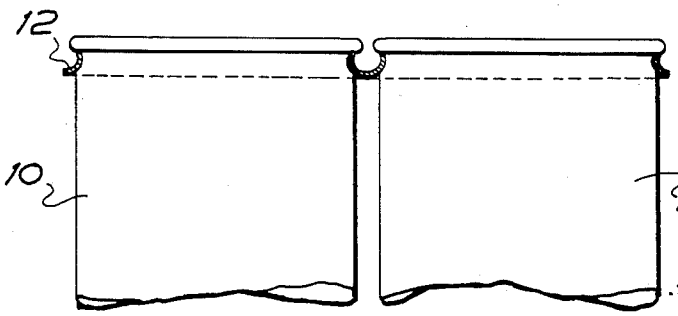
FIG. 2 is a sectional elevation of the group of containers shown in FIG. 1, the section being taken on the line II—II in FIG. 1.
Figure 5:
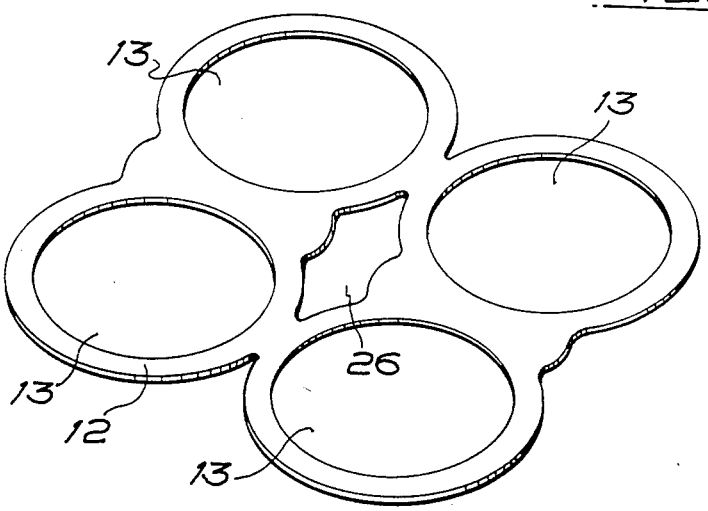
FIG. 5 shows a perspective elevation of a HICONE holding device.

Referring to the drawings, in FIG. 1 there is shown four beer cans 10 arranged in a square array and having their top ends held together by means of a HICONE holding device comprising a plastics material sheet 12 (see FIG. 5) having apertures 13 therein, and in which apertures the containers are held, the plastic material being stressed so as to grip the top of the containers resiliently, and being of sufficient strength to perform the holding function, and also to enable the group of containers to be lifted, by lifting one container with the hand, or by lifting the containers by inserting the fingers in apertures 13.

Figure 3:
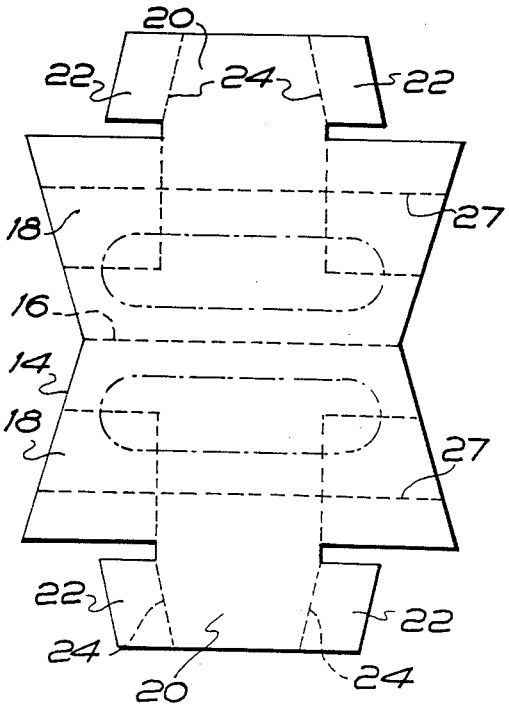
FIG. 3 is a plan view of a blank of a lifting device according to the present invention.

The device according to an embodiment of the present invention is for use in connection with the holder shown in FIG. 1, and the embodiment of the invention as shown in FIG. 3 comprises a blank 14 of cut and creased material, for example cardboard, which can be arranged co-operatively with the holder in order to enable the group of four containers to be lifted by means of the lifting device.

Figure 4:
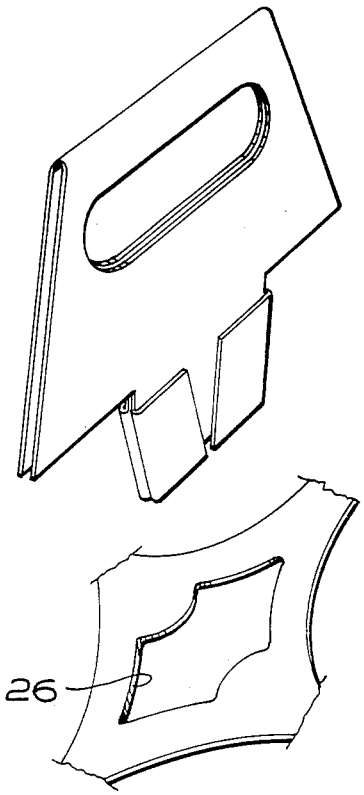
FIG. 4 shows a lifting device according to FIG. 3 when erected and ready to be inserted into the holding device which holds the containers together.
Figure 6:
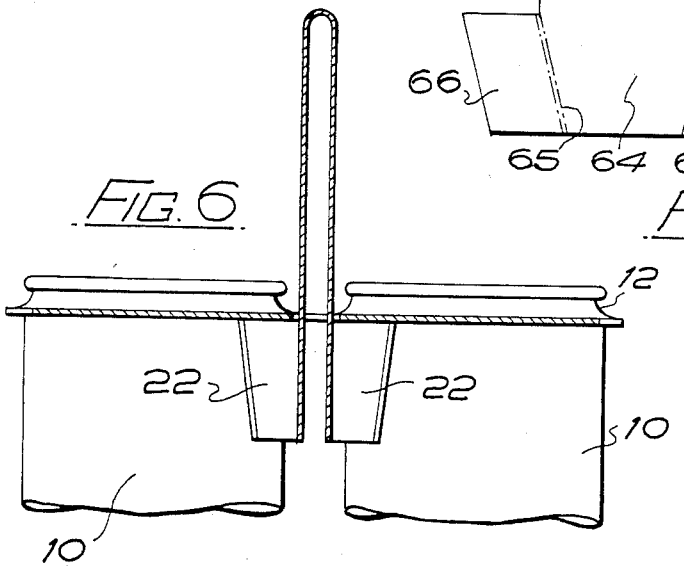
FIG. 6 shows a sectional elevation of the container holding device and the lifting device engaging the holding device.

In the example illustrated in FIG. 3, the blank is of cardboard material, and is symmetrical about the axis of symmetry 16. Each half of the blank comprises a trapezium shaped portion 18, from which extends a central tongue 20, and to each side of the tongue is a hinged lifting flap 22. In order to fold the blank shown in FIG. 3, to make it suitable for engagement with the container holder, it is folded about the line 16, and then the lifting flaps are folded along fold lines 24, through 180 degrees back onto the tongues 20. The thus folded flaps 22 and the associated tongues 20 are pushed through the central, generally diamond shaped aperture 26 (FIGS. 4 and 5) in the holder, and then the held flaps 22 are released. The flaps 22 subsequently spring outwardly by virtue of the resilience of the material from which the blank is made, thereby to catch under the holder 12, so that when the blank is lifted by means of the double thickness trapezium shaped portions 18, the said tongues 22 engage the underside of the holder and the holder and the held containers can be lifted as a unit for transportation as shown in FIG. 6. The flaps 22 are of such size as to spring back to engage the cans as shown in FIG. 6 in that they cannot spring back by more than 90°.

The trapezium shaped portions 18 may be provided with a finger aperture as shown in chain dotted lines, and the trapezium shaped portion may also carry printed material indicating special offers or other advertising information.

Instead of the aperture of the fingers, the trapezium shaped portion may be cut away as shown in dotted lines in FIG. 3 in order to provide a generally T-shaped panel defining a long tongue 20 so that when the device according to the invention is inserted in the aperture 26 in the holder, it is pushed downwards so that the tongue will lie centrally within the group of containers with the top section of the carrier lying between the top edges of the containers and projecting only slightly above same. This arrangement is of particular advantage when, as is usually the case, the containers are shrinked wrapped in dozens.

As regards the arrangement shown in FIG. 3, if this is employed with containers which are shrink wrapped, then the trapezium shaped portions may require to be folded down onto a pair of adjacent container top ends, about the fold lines 27.

In actual practice, the holding devices 12 are applied to groups of containers on a continuous basis, there being a large sheet of plastics material in which the holders are formed, the sheet being suitably punched and creased and the sheet, whilst in stretched condition, is applied onto the container ends as they move on a conveyor. The sheet is subsequently cut to define the individual holding devices, holding groups of four containers, and the lifting devices according to the invention may be applied to the plastics sheet material of the holders before or after severing of the sheet material, and indeed before the sheet material is applied to the containers. The lifting devices may be applied manually, or by suitably adapted machinery.

Figure 7:
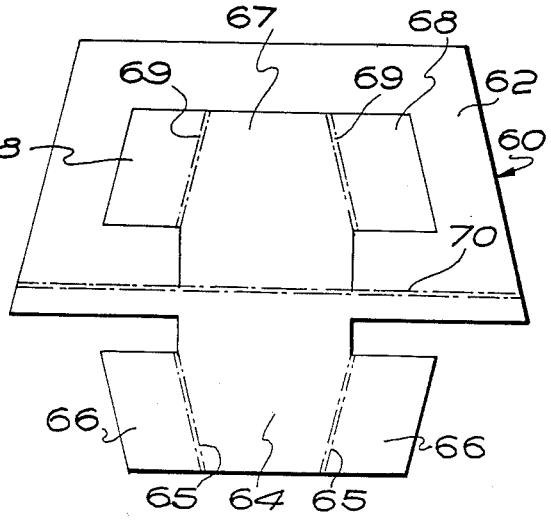
FIG. 7 is a plan view of a lifting device blank according to a second embodiment of the invention.
Figure 8:
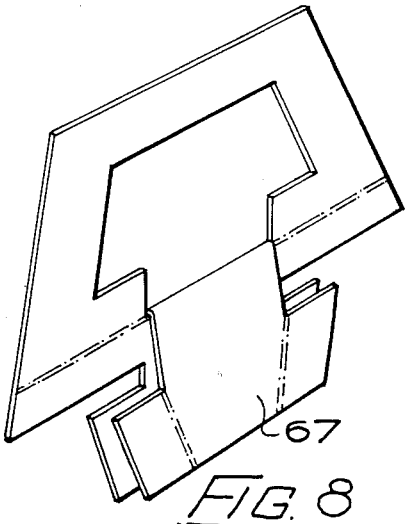
FIG. 8 shows the blank of FIG. 7 partly erected.
Figure 9:
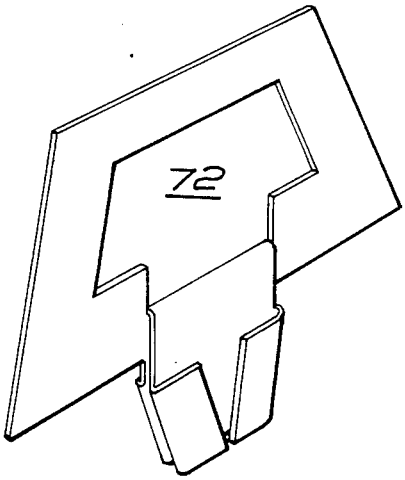
FIG. 9 shows the blank of FIG. 8, when fully erected, ready for insertion in the holding device.

Referring to FIGS. 7, 8 and 9, a second embodiment of the invention is shown. FIG. 7 shows a blank 60 of cardboard material comprising a trapezium shaped portion 62 from which extends a tongue 64. The tongue has side locking flaps 66 which are similar to the flaps 22 of the FIG. 3 embodiment. A cut in the portion 62 defines a second tongue 67 of a shape similar to tongue 64 and tongue 67 has flaps 68. A crease line 70 extends across the portion 62 as shown so that the tongue 67 can be folded out of the portion 62 as shown in FIG. 8 to lie in exact register with the tongue 62. To prepare the lifting device for engagement with the holding device, the flaps 22 and 68 are folded about folds 65, 69 back on the tongues 64, 67 as shown in FIG. 9. In the FIG. 8 position, the lifting device is ready to be engaged in the holding device in the same manner as described in relation to the embodiment of FIGS. 1 to 6 (see in particular FIG. 4). An advantage of the FIGS. 7 to 9 embodiment is that it uses less board and also the displacement of the tongue 67 out of portion 62 simultaneously forms a lifting aperture 72.

Figure 10:
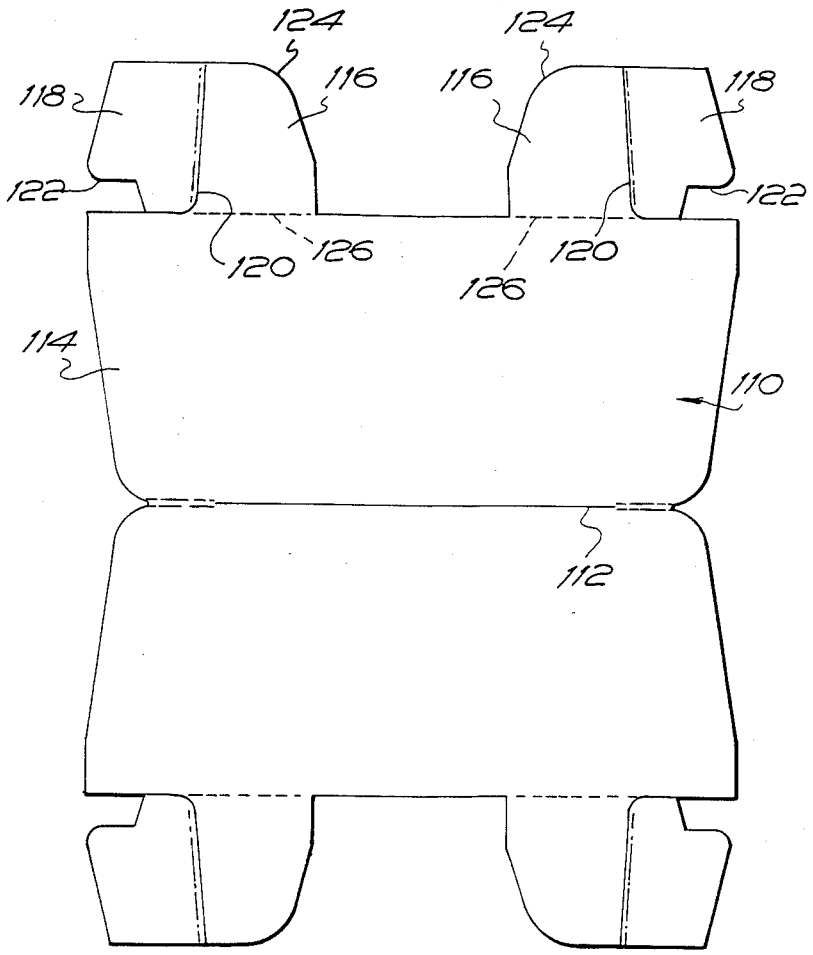
FIG. 10 is a plan view of a blank forming a lifting device according to another embodiment of the invention.
Figure 11:
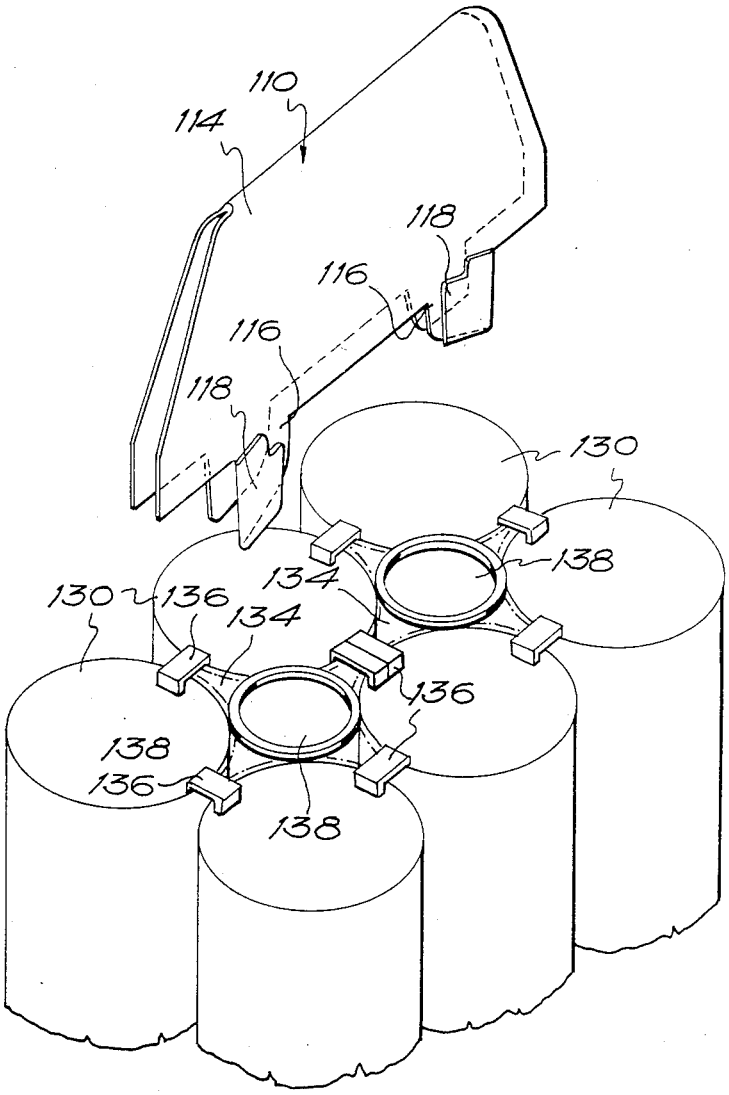
FIG. 11 shows the device of FIG. 10 already to be inserted into operative relationship with a pack of six cans.
Figure 12:
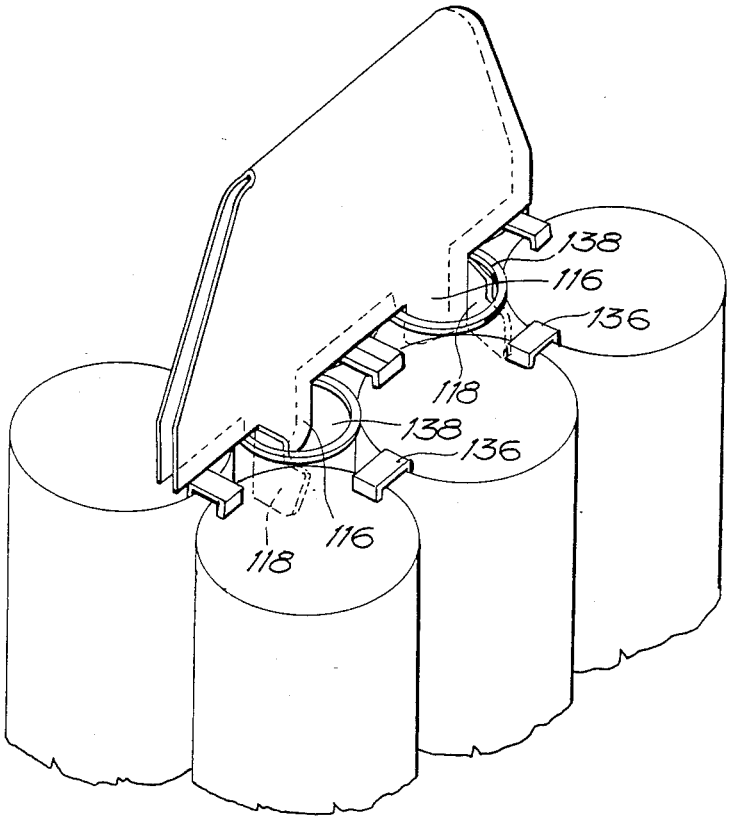
FIG. 12 shows in respective elevation the arrangement of FIG. 11 with the device according to FIG. 10 in position.

Referring to FIGS. 10 to 12 of the drawings, the blank 110 of FIG. 10 is symmetrical about a fold line 112, about which the blank is folded in use, and to each side of the fold 112 is a trapezium shaped lifting panel 114, to the opposite edges of which are extensions or tongues 116, spaced as shown, and each tongue is provided with fold back flap 118, hingeable about fold line 120, which lies transversely in relation to the line 112. One edge of each flap 18 is provided with a shoulder 122, and the opposing edges of the tongues 116 are curved as shown at 124.

To use the device shown in FIG. 10, it is folded about line 112 (which may be partly defined by a cut through the material) and then the flaps 118 are folded upwardly by 180° onto the outsides of the respective tongues 116 as shown clearly in FIG. 11.

Because the blank shown in FIG. 10 is symmetrical, the tongues 116 become face to face in pairs as shown in FIG. 11 when the blank is folded.

In the condition shown in FIG. 11, the blank is ready for application to a pack of six cylindrical containers 130 arranged as shown in FIG. 11 in two rows each of three containers, and the containers are clipped together by means of a pair of similar clip members 134 of generally cross-shape having clips 136 at the ends of the arms, and each having a central hole or aperture 138. It can be seen that each clip member 134 is positioned at the top and centrally of four of the groups of containers, and the two clip members 134 are each connected to the central container of each row of containers, whereby the six containers are held together in a pack.

The spacing between the tongues 116 is designed to be equal to the spacing between the holes 138 of the respective clips 134, so that the tongues and the folded over flaps as shown in FIG. 11 can be inserted in the holes 138, as shown in FIG. 12. To insert thee tongues and folded over flaps, they are held in the folded condition by suitable insertion equipment, and when insertin has been completed, the flaps 118 spring outwardly as shown in dotted lines in FIG. 12, whereby the top edges of the flaps 118, in particular show as at 122 engage under the clips 134, and the device 110 cannot be detached from the pack of containers without destruction of same. Thereby the device 110 is connected to the pack of containers 130 and the portions 114 can be gripped by the fingers and the pack of containers can be lifted by the lifting device. The panels 114 can be used for the display of advertising or other material. If the pack of containers with the lifting device 110 attached is to be shrink wrapped, the panels 114 can be folded downwardly so as to lie flat on the container tops, to this end, the blank 110 may be provided with additional fold lines 126 between the tongues 116 and the panels 114, as shown by dotted lines in FIG. 10.

The curved edges 124 of the tongues 116 permit easier insertion of the tongues with folded over flaps, but the device cannot be connected to the pack of containers unless the flaps 118 are folded to the position shown in FIG. 11.

When the device is inserted as shown in FIG. 12, the tongues 18 spring back to the dotted line position shown in FIG. 12, in which the flaps 118 rest against the walls of the containers and/or the clip member 134, and lie at an angle of less than 90° relative to the tongues to which they are hinged.

Figure 13:
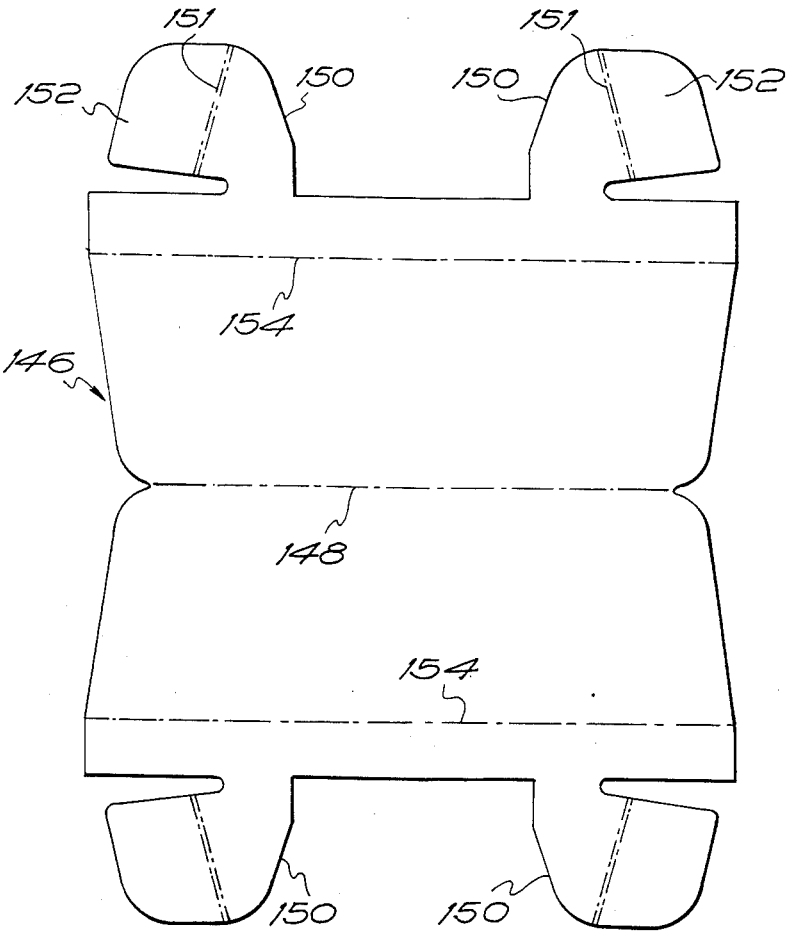
FIG. 13 is a plan view of a blank for forming a device according to another embodiment of the present invention.
Figure 14:
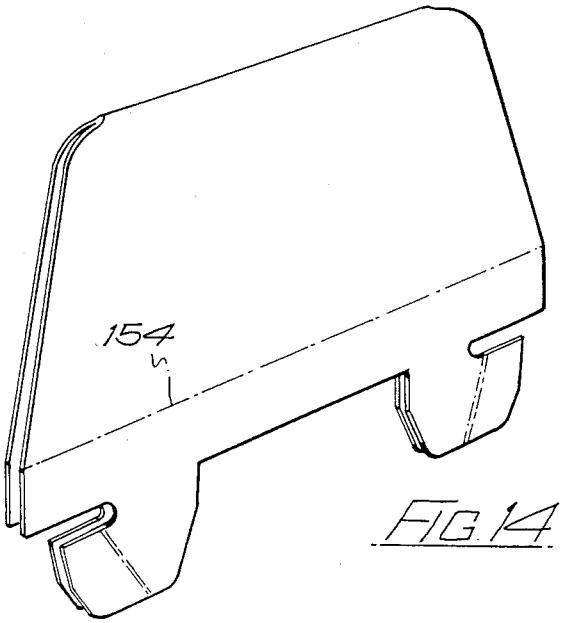
FIG. 14 shows the blank of FIG. 13 in a first stage of erection.
Figure 15:
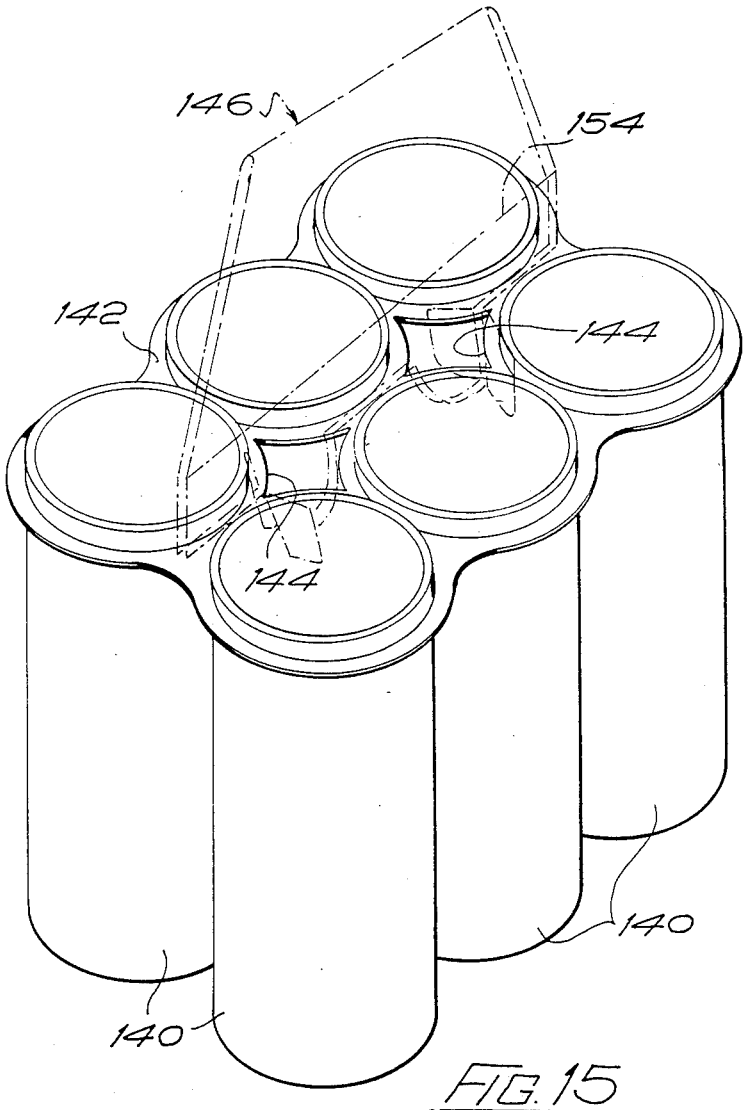
FIG. 15 shows a group of containers held together by a plastics web holding device and to which is fitted the lifting device of FIG. 14.

The embodiment of the invention shown in FIGS. 13 to 15 is very similar to that shown in FIGS. 10 to 12, but is for use in connection with a HICONE holding device for a six pack of containers. The construction can be best explained by referring to FIG. 15, which shows six cans, typically beer cans 140, which are held together by the plastic web 142 in known manner. In the web are additional holes 144, which are located centrally of the web so that each hole is equidistant from a group of containers, as shown. The device 146 according to the invention is shown in dotted lines in FIG. 15 and in position in operative engagement with the web 142.

It is now convenient to refer to FIG. 13 to describe the features of the device, which is in the form of a blank 146 symmetrical about hinge line 148, and as in the previous embodiment provided at the free edge of each half with tongues 150. The tongues are spaced equal to the space in between the lifting holes 144 of the plastic web shown in FIG. 15, and connected to each of the tongues 150 by means of a hinge in the form of crease line 151 is a hooking flap 152. The hinge line 150 on each tongue is inclined significantly to the central hinge line 148, for a purpose to be explained, and finally each of the halves of the blank is provided with a fold line 154 which is parallel to the fold line 148.

The fold lines may be defined by creasing or skip cuts or the like.

Figure 16:
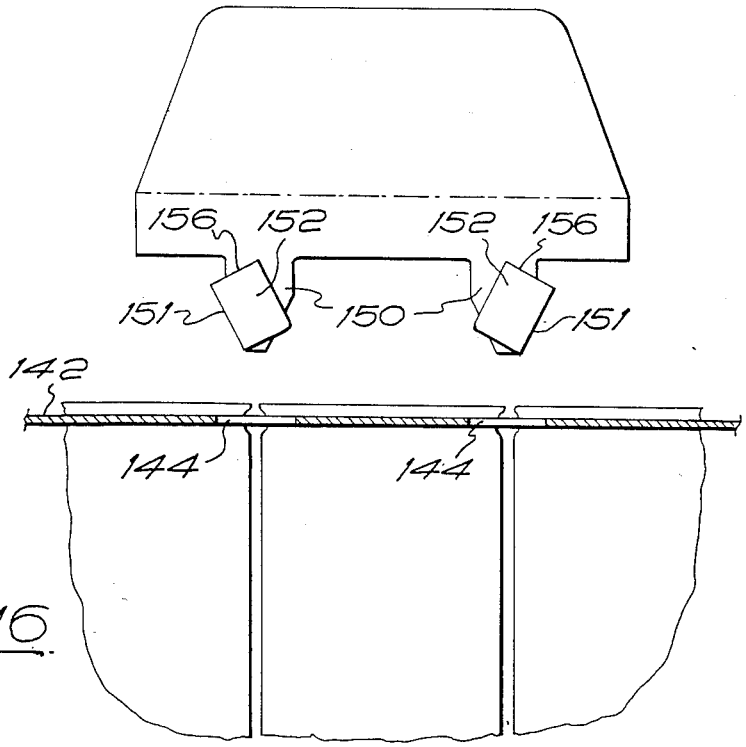
FIG. 16 is a side view illustrating how the holding device shown in FIG. 17 is applied to the group of containers.

To apply the device shown in FIG. 13 to a container as shown in FIG. 15, the device is first of all folded about a fold line 148 so that the position indicated in FIG. 14 is reached, and next the flaps 152 are folded about the fold line 151 to the position shown in FIG. 16, in which the top edges 156 of the said flaps 152 incline upwardly as shown in FIG. 16. This is achieved by inclining the fold lines 151 as shown in FIG. 13. The flaps 152 are folded by 180° on to the tongues 150, and the groups of tongues and flaps are passed through the apertures 144 in the web 142. The tongues and flaps are designed so that they will pass neatly through the apertures 144, and when through the apertures the flaps 152 spring to the positions shown in FIG. 15 in which they lie under the web 142 and in fact hook under the web whereby the device cannot be retracted, and when the device is lifted, lifting of the group of containers is effected.

The devices according to the invention can be used in connection with groups of more than six cans or indeed less than six cans provided that there is one or are two apertures for receiving the tongues and flaps. The flaps are designed so that when they spring outwardly the position shown in FIG. 15, the extent to which they can spring is limited to less than 90° relative to the tongues by the containers and/or the holding device.

It is to be noted that in the embodiments of the invention shown in FIG. 13, the shoulders 22 of the FIG. 10 embodiment have been deleted. This is because of the nature of the holding device in relation to which the device according to the invention is to be used.

The hinge lines 154 enable the main portions of the lifting device to be folded down on to the tops of the cans when the device is in the FIG. 15 position.

I claim:

1. A lifting device comprising a blank of cut and creased sheet material, said blank being adapted to be folded to a condition suitable for insertion into aperture means of a holding device holding a group of containers together so that a part of the lifting device will hook under the holding device whereby the group of containers can be lifted by lifting the lifting device, the said lifting device comprising (a) a first panel portion having a hinge edge and a free edge at the opposite side of the first panel portion from the hinge edge, (b) a second panel portion having a hinge edge and a free edge at the opposite side of the second panel portion from the hinge edge, (c) a main hinge line connecting the hinge edges of the first and second panel portions, (d) first tongue means extending from the free edge of the first panel portion, (e) second tongue means extending from the free edge of the second panel portion, said first and second tongue means being located so that hinging the blank about the main hinge line brings the first and second panel portions face to face and the first and second tongue means face to face, (f) first tongue hook flap means, (g) first tongue hinge line means hingedly connecting the first tongue hook flap means to the first tongue means, (h) second tongue hook flap means, (i) second tongue hinge line means hingedly connecting the second tongue hook flap means to the first tongue means so that the first and second hook flap means can be folded about the first and second tongue hinge line means onto the outsides of the first and second tongue means when the first and second panel portions are folded into face to face condition, so that the device can be held in folded but flat condition for insertion of the tongues and folded flap means into the aperture means of the holding device;

(j) first hook edge means on the first tongue flap means, (k) second hook edge means on the second tongue flap means, said first hook edge means and second hook edge means lying at the tops of the first and second tongue flap means and extending from said first and second tongue hinge means in an upwardly inclined manner towards the main hinge line when the device is in the folded condition ready for insertion in said aperture means with the main hinge line at the top thereof.

2. A device according to claim 1, wherein the said first and second hinge line means are arranged to lie at an acute angle to the said main hinge line.

3. A device according to claim 2 including, (l) a first panel portion auxiliary hinge line which is parallel to said main hinge line, (m) a second panel portion auxiliary hinge line which is parallel to said main hinge line, said first and second panel hinge lines being in register when the first and second panel portions are folded about the main hinge line, so that the sections of the first and second panel portions between the main hinge line and the in register first and second panel portion auxiliary hinge lines can be folded flat onto the tops of the containers after insertion of the device into the aperture means of the holding device.

4. A device according to claim 1, including, (l) a first panel portion auxiliary hinge line which is parallel to said main hinge line, (m) a second panel portion auxiliary hinge line which is parallel to said main hinge line, said first and second panel hinge lines being in register when the first and second panel portions are folded about the main hinge line, so that the sections of the first and second panel portions between the main hinge line and the in register first and second panel portion auxiliary hinge lines can be folded flat onto the tops of the containers after insertion of the device into the aperture means of the holding device.

5. A device according to claim 1, wherein each of the first and second panel portions is of generally rectangular shape.

6. A device according to claim 5, wherein the blank is symmetrical about the main hinge line.

7. The combination of a group of cans held together by a holding device comprising a web of plastics materials holding the cans in main apertures therein and having auxiliary aperture means, and a lifting device, said lifting device comprising (a) a first panel portion having a hinge edge and a free edge at the opposite side of the first panel portion from the hinge edge, (b) a second panel portion having a hinge edge and a free edge at the opposite side of the second panel portion from the hinge edge, (c) a main hinge line connecting the hinge edges of the first and second panel portions, (d) first tongue means extending from the free edge of the first panel portion, (e) second tongue means extending from the free edge of the second panel portion, said first and second tongue means being in face to face relationship and the first and second panel portions being hinged about the main hinge line, (f) first tongue hook flap means, (g) first tongue hinge line means hingedly connecting the first tongue hook flap means to the first tongue means, (h) second tongue hook flap means, (i) second tongue hinge line means hingedly connecting the second tongue hook flap means to the second tongue means, the first and second hook flap means being folded about the first and second tongue hinge line means and hooking under the web, the tongue means being located in the auxiliary aperture means of the web;

(j) first hook edge means on the first tongue flap means, (k) second hook edge means on the second tongue flap means, the first and second hook edge means extending upwardly under the plastics web so as to be trapped between the web and the surfaces of the cans.

8. The combination according to claim 7, wherein the lifting device further includes (l) a first panel portion auxiliary hinge line which is parallel to said main hinge line, (m) a second panel portion auxiliary hinge line which is parallel to said main hinge line, said first and second auxiliary panel hinge lines being in register when the first and second panel portions are folded about the main hinge line, so that the first and second panel portions lie face to face to form a flat display surface, but the sections of the first and second panel portions between the main hinge line and the in register first and second panel portion auxiliary hinge lines can be folded flat onto the tops of the cans for transportation and packaging.

9. A lifting device comprising a flat blank of cut and creased sheet material, such device being adapted to fit into an aperture of a holding device such as a HICONE holding device holding a group of containers together, said device comprising:

(a) a first panel portion;

(b) a second panel portion;

at least one of said first and said second panel portions defining a handle and also a display area whereby printing may be carried thereby for the purposes, for example, of indicating a special offer, (c) first tongue means extending from an edge of the first panel portion;

(d) second tongue means extending from an edge of the second panel portion;

(e) a main hinge line connecting the first and second panel portions and about which the device can be folded into substantially flat condition to bring said edges of the first and second panel portions together and the first and second tongue means into face to face relationship;

(f) secondary hinge line means in said first and second tongue means defining first and second catching flap means for folding onto the outsides of the tongues when they are face to face so that the device remains substantially flat and so that the face to face tongues and the folded back catching flap means can be inserted through an aperture in the holding device, until the flap means spring back to engage under the holding device to provide a means for lifting the group of containers;

(g) the handle has a finger engaging aperture; and (h) the device has a panel of trapezium shape from one side of which projects one of said tongues and the other tongue with its flap means is defined in said panel and can be folded out of the panel into superimposed face to face relationship with said one tongue, the folding of the tongues out of the panel defining a finger engaging aperture.

10. A lifting device according to claim 9, wherein the flap means of each of said tongues comprises a flap on each side of the tongue.

11. A lifting device according to claim 10; wherein the device is a blank of cut and creased sheet material having a fold line along an axis of symmetry and when folded about said line, handle portions on opposite sides of the fold line come face to face as do the said tongues which extend from face edges of the handle portions.

12. A lifting device according to claim 9, wherein the device is a blank of cut and creased sheet material having a fold line along an axis of symmetry and when folded about said line, handle portions on opposite sides of the fold line come face to face as do the said tongues which extend from face edges of the handle portions.

* * * * *